US008632356B2

(12) United States Patent
Bihrer et al.

(10) Patent No.: US 8,632,356 B2
(45) Date of Patent: Jan. 21, 2014

(54) ELECTRICAL PLUG CONNECTOR

(75) Inventors: Markus Bihrer, Althengstett (DE); Johann Krech, Horb am Neckar (DE)

(73) Assignee: Lapp Engineering & Co., Cham (CH)

( * ) Notice: Subject to any disclaimer, the term of this patent is extended or adjusted under 35 U.S.C. 154(b) by 85 days.

(21) Appl. No.: 13/378,277

(22) PCT Filed: Jun. 11, 2010

(86) PCT No.: PCT/EP2010/003527

§ 371 (c)(1),
(2), (4) Date: Jan. 20, 2012

(87) PCT Pub. No.: WO2010/149282

PCT Pub. Date: Dec. 29, 2010

(65) Prior Publication Data

US 2012/0115351 A1 May 10, 2012

(30) Foreign Application Priority Data

Jun. 25, 2009 (DE) ..... 10 2009 030 463

(51) Int. Cl.
*H01R 4/24* (2006.01)
*H01R 4/26* (2006.01)
*H01R 11/20* (2006.01)

(52) U.S. Cl.
USPC ..... 439/442; 439/843; 439/851

(58) Field of Classification Search
USPC ..... 439/442, 843, 851, 277, 839
See application file for complete search history.

(56) References Cited

U.S. PATENT DOCUMENTS 3,141,723 A 7/1964 Bonhomme
3,453,587 A * 7/1969 Neidecker ..... 439/843
3,763,460 A * 10/1973 Hatschek et al. ..... 439/277
3,861,776 A * 1/1975 Deal ..... 439/434
4,550,972 A * 11/1985 Romak ..... 439/839
5,486,123 A * 1/1996 Miyazaki ..... 439/825
5,898,993 A * 5/1999 Inaba et al. ..... 29/874
6,017,253 A * 1/2000 Schramme ..... 439/851
6,042,432 A * 3/2000 Hashizawa et al. ..... 439/843
6,062,919 A * 5/2000 Trafton ..... 439/843
6,350,149 B1 2/2002 Nakane
6,398,592 B1 * 6/2002 Mori et al. ..... 439/700
7,387,532 B1 * 6/2008 Mao ..... 439/578

FOREIGN PATENT DOCUMENTS

DE 36 29 740 A1 3/1987
DE 102 01 734 A1 8/2003
DE 10 2004 002404 B3 9/2005
EP 0 274 012 A2 7/1988
EP 0 352 088 A1 1/1990

OTHER PUBLICATIONS

International Search Report for corresponding PCT/EP2010/003527 completed Aug. 31, 2010 by Michel Bertin of the EPO.

* cited by examiner

*Primary Examiner* — Hae Moon Hyeon

(57) ABSTRACT

The invention relates to a plug connector having a main part, comprising a contact blade basket or skirt having at least one first and one second contact zone. Said contact zones are disposed one after the other in the longitudinal direction of the plug connector and have a plurality of contact blades. Adjacent contact blades are separated from each other by a gap. An intermediate wall is provided between the contact zones disposed one after the other, forming a conductive contact both between the contact blades of the first contact zone and the contact blades of the second contact and between the individual contact blades of the first contact zone and the individual contact blades of the second contact zone.

12 Claims, 4 Drawing Sheets

ELECTRICAL PLUG CONNECTOR

FIELD

In the following, an electrical plug connector will be described. In particular, it is an electrical plug connector with a contact element which has a contact blade skirt or basket that may have a round, e.g. circular shape. The contact blade skirt comprises at least two contact zones. The term plug connector as used herein selectively refers to a plug or a socket in accordance with the common definition. The at least two contact zones at the contact blade skirt allow a voltage drop to be minimised at interfaces between a plug and a contact making socket. However, the shape or deformation of contact blade skirts give rise to the tendency that the electrical current flowing therethrough is concentrated to only a few contact blades.

TECHNICAL BACKGROUND

Document EP 1 478 055 A1 describes a contact blade basket or skirt of an electrical plug connector, whose contact blades comprise at least two arc-shaped portions with opposed curvature. In simple terms, a contact blade with three arc-shaped portions is generated, of which the outer two portions—when viewed from the inside of the contact blade skirt—are convex, while the centre portion is concave. When the plug is inserted into the contact blade skirt, it contacts the two outer portions so that the contact blades are radially deflected.

In DE 10 2005 017 988 B3 an electrical contact socket is described which has a plurality of elongated spring elements for electrically contact making of a plug element and an outer contact socket which surrounds the contact socket. The spring elements which are elongated in the axial longitudinal direction comprise at least two tapering portions which are arranged spaced in the axial longitudinal direction for multi-point contact making of a plug element inserted into it. In addition, they have at least two consecutive expansion portions which are spaced in the axial longitudinal direction for multi-point contact making of an outer contact socket. The expansion portions are curved convexly, while the tapering portions are curved concavely.

Problem

Though the contact blade configuration which is described in EP 1 478 055 A1 allows a constant contact force over many coupling cycles, it may cause an unbalanced load on the contact blade. With a non-uniform contact making along the circumference, which results from manufacturing tolerances, wear or a transverse force applied to the wire or cable, the current transfer concentrates on individual contact blades. This may cause heavy heating of the current-carrying contact blades. Due to the fact that the individual contact blades are separated from one another by air gaps, the resulting heat dissipation may be distributed only insufficiently. Moreover, the contact blades are usually made from a material with a positive temperature coefficient; therefore, the electrical resistance of the contact blades increases with increasing temperature.

A major drawback of the contact socket described in DE 10 2005 017 988 B3 is the double transition resistance, because a voltage drop occurs both at the contact points between the outer contact socket and the spring element and at the contact points between spring element and plug. For this configuration of the contact socket, it is particularly critical that the transition resistance increases due to frictional corrosion and other wear phenomena.

Another drawback of the known contact blade skirts is that the elasticity of the used materials, generally copper or copper alloys, such as e.g. beryllium copper, decreases with increasing temperature. This results in a lower spring effect and thus in a lower contact force. Therefore, a decrease in elasticity also causes an increasing transition resistance.

Because these detrimental effects are amplified by the temperature dependency, there is a risk that the plug connector will be damaged or destroyed due to overload. In addition, the transition resistance increases over the life of the plug connector and the elasticity of the contact blades decreases. It is therefore necessary to provide a safety margin in the design in order to avoid damage of the plug connector. This entails overdimensioning of the contact blade skirts and/or the necessity to use special electro-coatings for reducing the transition resistance.

Object

It is therefore the object to provide a contact element with a contact blade basket or skirt for an electrical plug connector, whose geometry enables a uniform distribution of the electrical current through the plug connector and of the dissipation of heat, and which, at the same time, is less susceptible to temperature increases.

Solution

For the solution of this object, a plug connector with a contact element is proposed, which has a main part which comprises a contact blade skirt with at least a first and a second contact zone. The contact zones are arranged one behind the other in the longitudinal direction of the plug connector and have a plurality of contact blades which are arranged side by side along the circumference of the contact blade skirt. Neighbouring contact blades of one contact zone are separated from each other by a gap. Between the first and second contact zone, an intermediate wall is provided which forms a(n) (electrically) conductive connection both between the contact blades of the first contact zone and the contact blades of the second contact zone and between the individual contact blades of the first contact zone and the individual contact blades of the contact zone.

The configuration of the contact blade skirt which will be explained in the following makes it suitable for minimising the electrical voltage drop at the contact points and, at the same time, for uniformly distributing the electrical current over the entire contact blade skirt.

The intermediate wall between the contact zones of the contact blade skirt provides for a uniform distribution of the electrical current and the heat over the entire circumference of the contact blade skirt. The intermediate wall may extend over the entire circumference of the contact blade skirt or only over a part of it. It may also be interrupted by a separation slot or it may be continuous. Thereby, the intermediate wall may enhance the spring effect of the entire contact blade skirt so that the spring force—together with the current conduction—is uniformly distributed over the circumference of the contact blade skirt. This results in a definite advantage over the state of the art because current concentration is effectively avoided. Therefore, an additional safety margin is provided in conjunction with the higher spring force of the contact blade skirt.

In addition, a spring element may be provided which applies a force acting transversely to the longitudinal direction of the plug connectors to at least one of the contact zones of the contact blade skirt. If the plug connector forms a part of the socket, the force acts—in relation to the longitudinal axis of the plug connector—radially inwards. If the plug connector forms a part of the plug, the force acts radially outwards. The contact blade skirt and the spring element may be separate components.

For each contact zone of the contact blade skirt, the spring element may comprise an additional sprung blade. Likewise, the spring element may also comprise an intermediate wall between the sprung blades provided for the respective contact zones.

If the spring force of the spring element acts radially inwards, the spring element may be adapted to encompass the contact blade skirt in the circumferential direction at least partially. Due to the fact that the spring force of the spring element and the spring force of the contact blade skirt are equidirectional, the contact force may be increased by the spring element. Because a higher contact force reduces the transition resistance the spring element provides for an additional safety margin.

In an embodiment of the plug connector, the contact blades of the various contact zones are arranged staggered relative to one another in the circumferential direction. In addition or alternatively, the contact blades of one or all contact zones may be arranged oblique to the longitudinal axis of the plug connectors.

The plug connector may be either a socket or a plug. Because the shape of the contact blade skirt reduces the transition resistance between plug and socket, the contact blade skirt may be made from an unalloyed metal without a special surface coating. Alternatively, it is also possible that the contact area of the entire main part comprises a surface coating, e.g. from tin or a tin alloy. Due to the good electrical properties, copper or alloys containing copper lend themselves as materials for the contact blade skirt.

The spring element may be, but need not be, provided for current conduction. Therefore, a material with a low electrical conductivity may be used for the spring element, which is selected in accordance with mechanical or manufacturing related properties. The spring element may consist of metal, e.g. steel, stainless steel, or synthetic material.

Thus, the spring element and the contact blade skirt may be formed from different materials. In an embodiment, the spring element may be made of steel and the contact blade skirt may be made of copper.

The contact blades may also be made in such a manner that the cross section of the contact blades tapers towards the centre, so that the distance between neighbouring contact blades is the greatest in the centre of the contact blades. In addition or alternatively, an embossed contact making point may be provided on each contact blade. These contact making points may be located both on the inside and the outside and on both sides of the contact blade skirt. The contact making points on the outside allow the selective introduction of the spring force of the spring element into the contact blades. If the contact making points are located on the inside, the making points form a defined current transfer between coupled plug connectors.

In an embodiment, the contact blade skirt is made as a stamped and bent part. The spring element may also be made as a stamped and bent part.

The front part of the contact blade skirt may be made in such a manner that interruptions are provided in an end ring. In addition or alternatively, recesses may be provided in the transition area between the contact blade skirt and the solid part of the main part. The spring force of the contact blades may be enhanced even further by the interruptions and/or recesses.

In an embodiment, at least one of the recesses may be longer than the remaining recesses to form at least one long recess. Two long recesses may be provided. The two long recesses may be arranged diametrically to each other. The intermediate wall may be interrupted at least once. The at least one interruption of the intermediate wall may be provided as an extension of a long recess. The at least one interruption of the intermediate wall may be provided oblique to the longitudinal axis of the plug connector.

The main part of the plug connectors may comprise a slot. The separation slot in the main part of the plug connector may extend, for example, in the longitudinal direction of the plug connector. The spring element may also comprise a slot. The separation slot in the spring element may extend, for example, in the longitudinal direction of the spring element. The separation slot in the main part of the plug connector may open into a recess or a long recess.

In an embodiment, the separation slot of the spring element may be arranged locked against rotation relative to the separation slot of the contact blade skirt. The slots of the contact blade skirt and of the spring element may be arranged diametrically to each other.

The main part of the present plug connector may be connected to an electrical conductor in a wide variety of ways; for example, a crimp connection, a screw connection, a screwless clipped connection, an insulation displacement connection, a flat cable plug connection, a winding connection, a weld connection or a press fit connection may be provided.

The contact blade skirt is also suited for use with any plug geometry. Though the figures illustrate circular plugs only, the present invention is also suited for e.g. a rectangular plug.

The contact blade skirt may be installed alone or as part of a greater assembly. The contact blade skirt need not necessarily be part of the main part of the plug connector.

SHORT DESCRIPTION OF THE FIGURES

In the following, the plug connector will be explained with reference to figures.

Figures 4A, 4B:
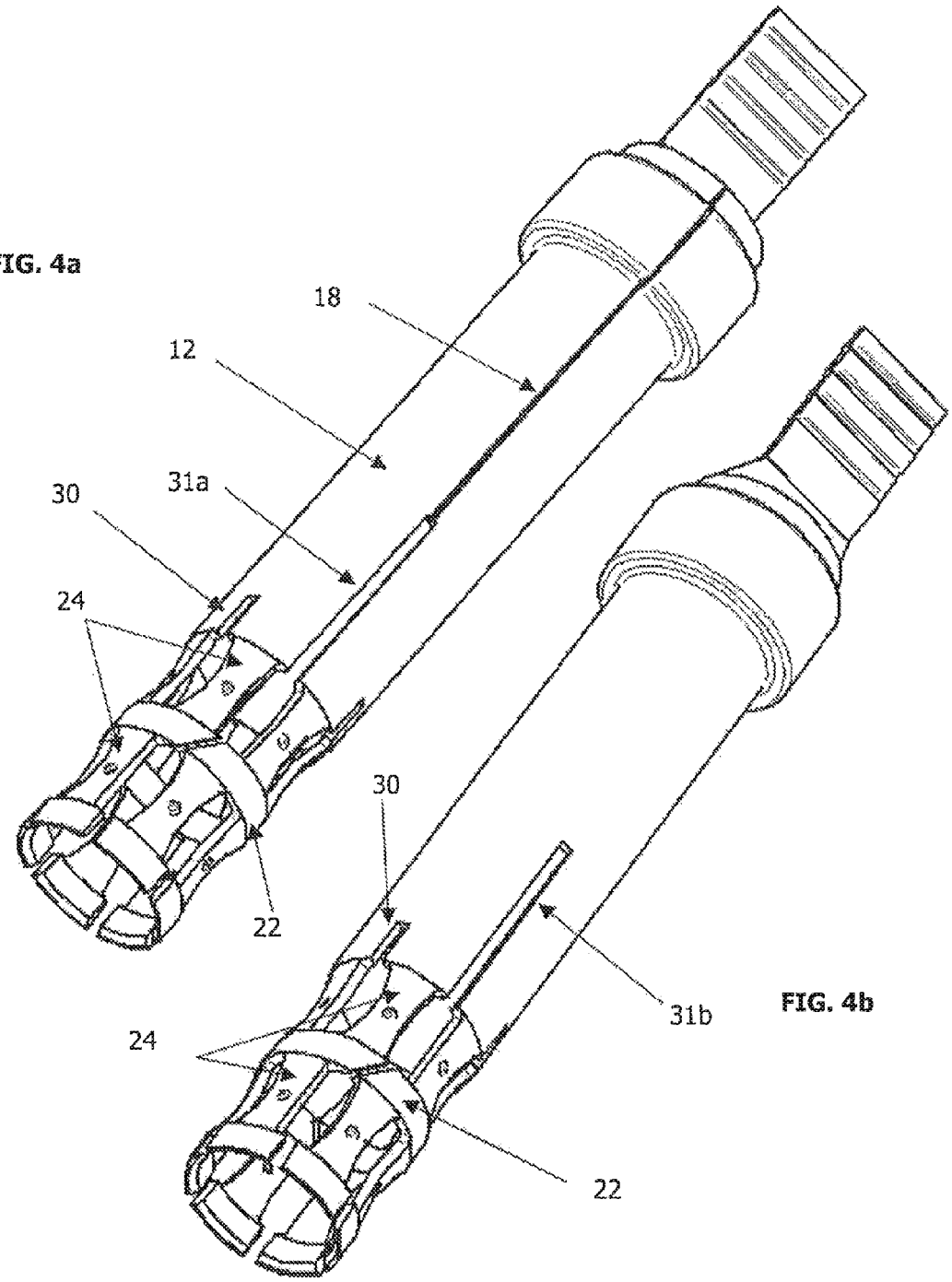

FIG. 4*a* is a first view of an embodiment with long recesses.

FIG. 4*b* is a second view of the embodiment with long recesses.

DETAILED DESCRIPTION OF THE FIGURES

The variant of the plug connector which will be described in the following is made as part of a socket. The plug connector may as well be part of a plug. Though in the following, only variants for a socket will be described for the sake of better understanding, it is obvious that only minor modifications are necessary to allow their use for as plug as well.

Figure 1:
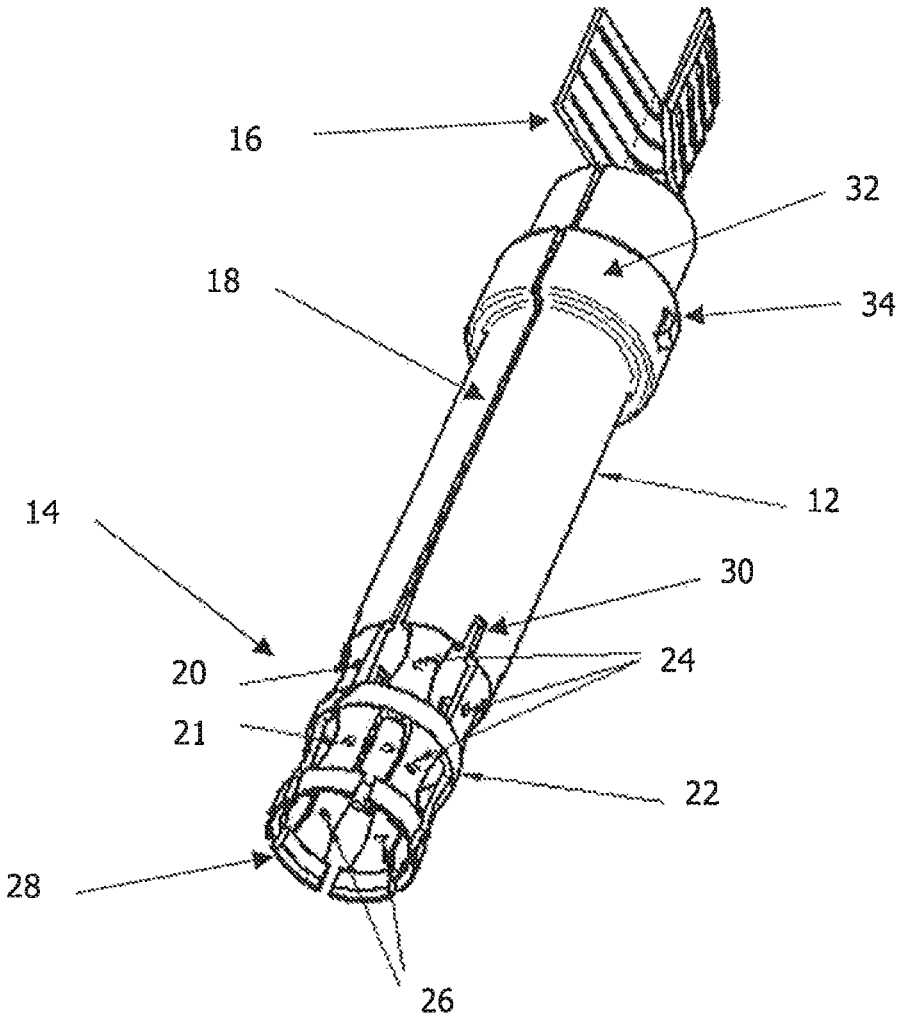
FIG. 1 shows an embodiment of the plug connector with contact blade skirt.

FIG. 1 illustrates the main part 12 of a contact element of a plug connector. A contact blade basket or skirt 14 is located in the front area of the plug connector, which faces the plug connection. At the opposite end of the main part 12, i.e. the rear area, an electrical/mechanical holder/contact for an electrical conductor, e.g. a crimp connection 16, is provided. In the variant of in FIG. 1, the main part 12 of the plug connector is a stamped and bent part. The main part 12 consists of a conductive material which is bent into a tubular shape. This material may be an unalloyed metal, e.g. copper. A separation slot 18 extends over the entire axial length of the main part 12.

The contact blade skirt 14 consists of a first and a second contact zones 21, 20 which are electrically connected by an intermediate wall 22. Said intermediate wall 22 extends over the entire circumference of the contact blade skirt 14 and is interrupted by the separation slot 18. A plurality of contact blades 24 is arranged in the contact zones 20, 21, which in the coupled condition rest against the plug. In the embodiment shown in FIG. 1, the cross section of the contact blades 24 tapers towards the centre, so that the distance between neighbouring contact blades is the greatest in the centre. Due to this tapering shape, the mechanical stress may be uniformly distributed within the blade. Because the cross section of the blade increases from the centre towards the intermediate wall 22, heat may be better dissipated from the contact zones 20, 21.

The contact blades comprise an embossed contact making point 26 in the centre on the inside of the contact blade skirt. This embossed contact making point 26 is provided as a defined contact with the plug. In addition, embossed contact making points 26 may also be provided at the outside of the contact blade skirt. The advantages of such contact making points 26 will be explained in detail in the description of FIG. 3.

The transitions between main part 12, contact blades 24 of the second contact zone 20, intermediate wall 22, contact blades 24 of the first contact zone 21 are seamless without a material transition. At the front end of the plug connector, the contact blades 24 merge into a front end ring 28 whose annular structure is interrupted by several gaps. This interrupted annular structure assists the elastic deformation of the contact blades 24 of the first contact zone 21. Thereby, the contact blades 24 of the first contact zone 21 may optimally adapt themselves to the geometry of the plug. Analogously, recesses 30 are provided in the main part 12. These recesses 30 may be formed as slots, which lengthen the gaps between the contact blades 24 into the main part 12. Due to the elasticity of the contact blades 24, they act like springs. When the plug elastically deforms the contact blades 24, a contact force is created which urges the contact making point 26 against the plug.

In the embodiment of FIG. 1, the contact blades 24 of the first and second contact zones 21, 20 are arranged staggered relative to one another in the circumferential direction. In addition or alternatively, the contact blades 24 may be arranged oblique to the longitudinal direction of the plug connector. The staggered arrangement of the contact blades 24 allows for a more effective compensation of the potential differences. Moreover, the electrical current in the contact blades 24 may be distributed more uniformly to the contact blades 24. In addition, mechanical wear of abrasion, respectively, may be reduced by a staggered arrangement of the contact blades 24. The result is that in a contact blade skirt 14 with two contact zones 20, 21 and a staggered arrangement of the contact blades 24 wear is not heavier than in a contact blade skirt with only one contact zone.

The main part 12 illustrated in FIG. 1 further comprises a double-sided annular bulb 32 and at least one radially oriented knob 34 at its outside. Thereby, the main part 12 may be simply and reliably positioned and secured in, for example, a two-part insulating contact carrier system which is not shown in detail. In the assembled condition, this contact carrier system completely encompassed the main part 12. Thereby, the main part 12 is protected against environmental influences and, at the same time, the current-carrying parts of the plug connector are insulated. An annular groove is provided in the contact carrier system, by which the double-sided bulb 32 may be supported. This prevents slipping of the main part 12 along the longitudinal axis of the plug connector. In addition, recesses are provided in the contact carrier system of the plug connector for the at least one knob 34. This prevents a relative rotational movement between the main part 12 and the contact carrier system. Moreover, the at least one knob 34 may also be used for positioning during the assembly, e.g. when crimping the connecting lines.

The radially outwardly protruding bulb 32 and/or the radially outwardly protruding knob 34 may also be formed protruding radially inward. In this case, corresponding complementary projections are formed in the contact carrier system. It is also possible to provide a mixed configuration of the protruding/retreating knobs/bulbs.

Figure 2:
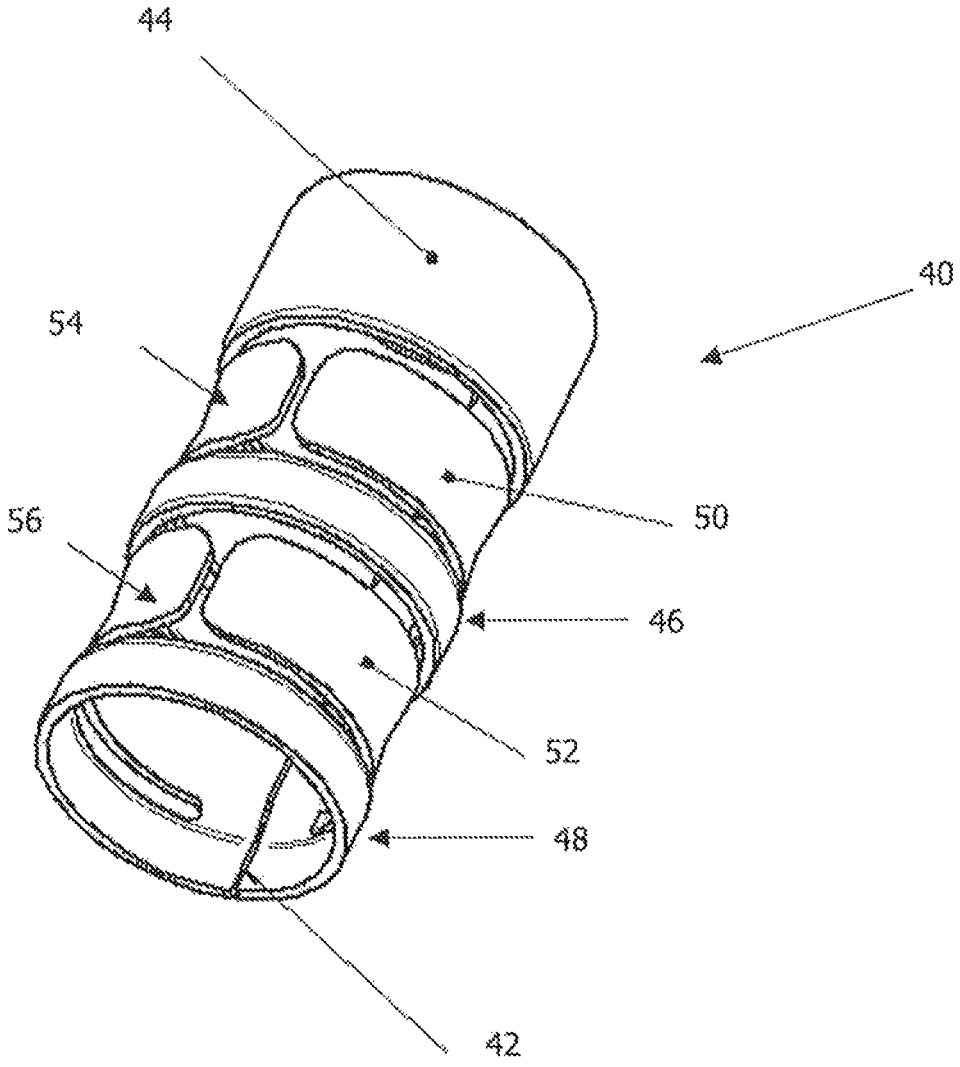
FIG. 2 shows an embodiment of the spring element.

FIG. 2 illustrates a spring element 40 which is made as a stamped and bent part. The spring element 40 consists of a material which is bent into a tubular shape. Because the spring element 40 is not intended for current conduction the spring element 40 may consist of a material which is selected in accordance with its mechanical properties. For this purpose, it is advantageous to use a material with a high modulus of elasticity. For example, steel or stainless may be employed. Because the modulus of elasticity of steel is greater than that of copper even at higher temperatures, the contact force may be maintained at a high level.

The spring element 40, too, comprises a separation slot 42. The illustrated embodiment consists of three circumferential rings 44, 46, 48 which are interrupted by the separation slot 42. Between these circumferential rings 44, 46, 48 sprung blades 50, 52, 54, 56 are arranged which are separated by gaps. The illustrated spring element 40 comprises four sprung blades 50, 52, 54, 56. The spring effect is achieved in that the sprung blades 50, 52, 54, 56, compared to the circumferential rings 44, 46, 48, comprise a gap in the axial direction. This gap may be arranged diametrically opposite the separation slot. The resulting arc structure assists the elastic deformation of the individual sprung blades 50, 52, 54, 56. In order to achieve an equal contact force which is applied to the first and second contact zones 21, 20 it is advisable to form the sprung blades 50, 52, 54, 56 in a similar manner. However, it is also possible to form sprung blades 50, 52, 54, 56 in such a manner that differences in contact making forces of the individual contact zones 20, 21 can be compensated.

Figure 3:
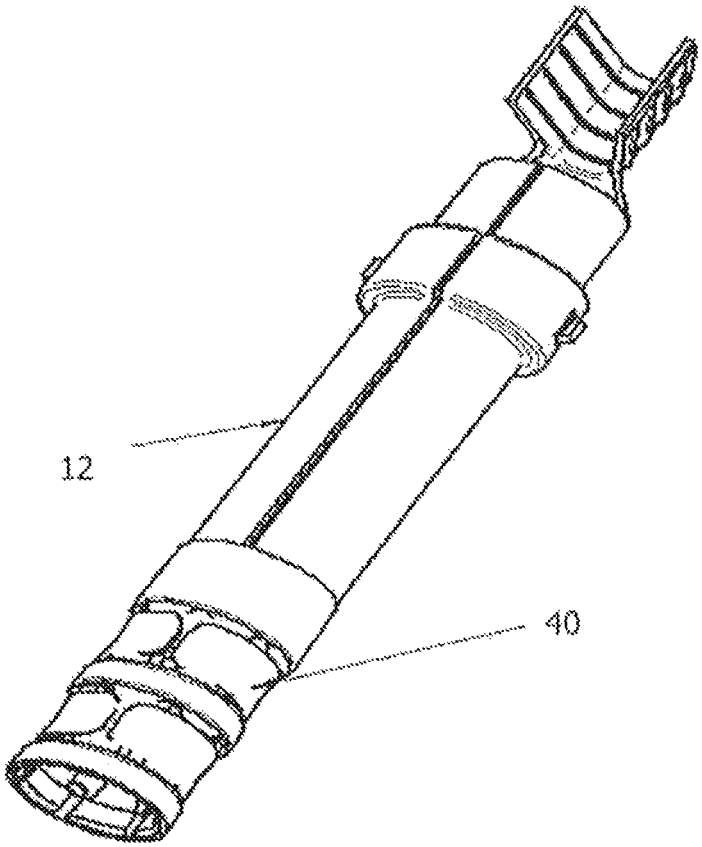
FIG. 3 shows a plug connector, with the spring element encompassing the contact blade skirt.

FIG. 3 shows a variant of the invention, in which the spring element 40 encompasses the contact blade skirt 14. The sprung blades 50, 52, 54, 56 are arranged in such a manner that one pair each of the sprung blades 50, 52, 54, 56 encompasses one contact zone 20, 21. In addition, the separation slot 18 of the main part 12 and the separation slot 42 of the spring element 40 may be arranged in such a manner that the two separation slots 18, 42 are disposed diametrically opposite one another. In order to prevent a relative movement of the spring element 40 and the main part 12 an anti-rotation protection (not shown in the figures) may be provided. This anti-rotation protection may, for example, consist of a dedicated recess and a blade which is in engagement with the recess. The recess may be provided both in the main part 12 and in the spring element 40. The decisive factor is that recess and blade are not provided on the same component and are arranged one above the other in the installed condition. Because the sprung blades 50, 52, 54, 56 encompass the contact zones 20, 21 they can apply a force acting transversely to the longitudinal direction of the plug connector to the contact zones 20, 21 of the contact blade skirt 14.

As already explained in the description of FIG. 1, it is also possible to provide contact making points 26 on the outside of the contact blade skirt 14. Said contact making points 26 form the interface between the contact blade skirt 14 and the spring element 40. Because the spring element 40 bears against the contact making points 26 only, the spring force is introduced selectively into the contact blades 24. Here, it is advantageous that the contact making points 26, when viewed in the axial direction, are arranged in the centre of the contact blades 24 and that the outer contact making points 26 and the inner contact making points 26 are located exactly opposite each other.

FIG. 4*a* shows a first view of the embodiment with long recesses. FIG. 4*b* shows a second view of the embodiment with long recesses. The first view may be a front view and the second view may be rear view of the plug connector.

The embodiment of FIGS. 4*a* and 4*b* mainly differs from the embodiment of FIG. 1 in that it comprises long recesses 31*a*, 31*b*. Therefore, a repeated description of the construction of the plug connector is omitted. The long recesses 31*a*, 31*b* may be provided instead of the recess 30 in the main part 12. The long recesses 31*a*, 31*b* extend farther into the main part 12 than the recesses 30.

The long recess 31*a* shown in FIG. 4*a*, for example, extends approximately four times as far into the main part 12 as a recess 30. Thus, the first long recess 31*a* is four times as long as a recess 30. It is obvious that the first long recess 31*a* may as well be shorter or longer. For example, the first long recess 31*a* may extend twice as far into the main part 12, i.e. twice as long as a recess 30. In the embodiment shown in FIG. 4*a*, the width of the first long recess 31*a* corresponds to the width of a recess 30. It is obvious that the first long recess 31*a* may readily be wider or narrower.

The first long recess 31*a* extends in the longitudinal direction of the plug connector into the main part 12. At one end, the first long recess 31*a* opens into the separation slot 18 of the main part 12. The first long recess 31*a* may therefore be seen as a widened part of the separation slot 18. At the other end, the first long recess 31*a* opens into a gap which separates two adjacent contact blades 24 from one another.

The intermediate wall 22, too, is interrupted. In the embodiment illustrated in FIG. 4*a*, the interruption of the intermediate wall 22 is arranged oblique relative to the longitudinal direction of the plug connector. The interruption of the intermediate wall 22 may open into the same gap between two contact blades 24 as the first long recess 31*a*. Thus, the interruption of the intermediate wall 22 may be arranged as an extension of the first long recess 31*a*.

FIG. 4*b* shows a second long recess 31*b*. Its length and width correspond to those of the first long recess 31*a*. However, it is readily apparent that the second long recess 31*b* may as well be narrower, longer or shorter than the first long recess 31*a*. The second long recess 31*b* may be disposed diametrically opposite the first long recess 31*a*. The second long recess 31*b* may also be arranged under a different angle to the first long recess 31*a*.

Another interruption is provided in the intermediate wall 22. Shape and arrangement of this interruption may correspond to the interruption of the intermediate wall 22, which was described with reference to FIG. 4*a*.

In the embodiment shown in FIGS. 4*a* and 4*b*, two long recesses 31*a*, 31*b* are provided in the main part 12 and two interruptions are provided in the intermediate wall 22. It is obvious that the number of the long recesses 31*a*, 31*b* and the interruptions of the intermediate wall 22 is merely exemplary.

The lever arm of the contact blade skirt 14 may be varied by the length of the long recesses 31*a*, 31*b*. Shortening of the long recesses 31*a*, 31*b* shortens the lever arm and lengthening of the long recesses 31*a*, 31*b* into the main part 12 lengthens the lever arm of the contact blade skirt 14. Because the length of the lever arm has an essential influence on the contact force which is applied by the contact blade skirt 14, the contact force of the contact blade skirt 14 may be varied by the shape of the long recesses 31*a*, 31*b*.

In general, the long recesses 31*a*, 31*b* cause a reduction of the contact force which is provided by the contact blade skirt 14. In order to compensate this reduction, the part of contact force which is applied by the spring element 40 may be increased. Because the shape of the spring element 40 in general provides for a more uniform application of the contact force than the contact blade skirt, the long recesses 31*a*, 31*b* therefore also cause a more symmetrical application of the contact force.

The invention claimed is:

1. A plug connector with a main part, the plug connector comprises a contact blade skirt or basket that has a round shape with at least one first and one second contact zone, wherein the first and second contact zones are arranged consecutively in the longitudinal direction of the plug connector, the contact zones have a plurality of contact blades, neighbouring contact blades of one contact zone are separated by a gap from one another, with an intermediate wall being provided between the first and the second contact zones, and with the intermediate wall forming a conductive connection both between the contact blades of the first contact zone and the contact blades of the second contact zone and between the individual contact blades of the first contact zone and the individual contact blades of the second contact zone, wherein a spring element encompasses the contact blade skirt at least partially in the circumferential direction, and wherein the spring element applies a force acting transversely to the longitudinal direction of the plug connector to at least one of the contact zones of the contact blade skirt, and wherein the spring element comprises at least one sprung blade for each contact zone.

2. The plug connector according to claim 1, wherein the spring element comprises an intermediate wall between the sprung blades for the respective contact zones.

3. The plug connector according to claim 1, wherein the contact blades of the first contact zone are arranged staggered relative to the contact blades of the second contact zone in the circumferential direction.

4. The plug connector according to claim 1, wherein the contact blade skirt comprises one or several surfaces of an unalloyed metal as the contact area, and/or wherein the spring element and the contact blade skirt consist of different materials, and/or wherein the contact blade skirt and the spring element are stamped and bent parts.

5. The plug connector according to claim 1, wherein the contact blades have a tapering cross section along the longitudinal direction, and/or at least one embossed contact making point which faces in the radial direction.

6. The plug connector according to claim 1, wherein the contact blade skirt towards the connector plug side opens into an end ring which is interrupted by gaps.

7. The plug connector according to claim 1, wherein the main part comprises at least one recess lengthening a gap separating neighbouring contact blades of the second contact zone.

8. The plug connector according to claim 7, wherein at least one recess is longer than the other recesses and thus forms a long recess.

9. The plug connector according to claim 8, wherein two long recesses are provided which are arranged diametrically relative to one another, and/or wherein the intermediate wall is interrupted at least once, preferably in an extension of at least one long recess.

10. A plug connector with one or several contact blade skirts as defined in claim 9.

11. The plug connector according to claim 1, wherein the main part comprises a double-sided bulb, and/or wherein the main part comprises at least one knob, and/or wherein the main part comprises a crimp connection, a screw connection, a screwless clipped connection, an insulation displacement connection, a flat cable plug connection, a winding connection, a press fit connection or a weld connection for connecting the main part with a conductor.

12. A contact body comprising a contact blade skirt which has at least two contact zones which are arranged one after the other in the longitudinal direction of the contact body, with the at least two contact zones consisting of several embossed contact blades, wherein the contact blade skirt comprises an intermediate wall between each contact zone, which connects both the contact blades of one contact zone and the contact blades of neighbouring contact zones, wherein the contact blade skirt is adapted to be encompassed by a spring element at least partially in the circumferential direction, the spring element applying a force acting transversely to the longitudinal direction of the contact body to at least one of the contact zones, and comprising at least one sprung blade for each contact zone.

* * * * *